US010249936B2

(12) United States Patent
Sayama et al.

(10) Patent No.: US 10,249,936 B2
(45) Date of Patent: Apr. 2, 2019

(54) ANTENNA DEVICE AND WIRELESS APPARATUS

(71) Applicant: AGC Inc., Chiyoda-ku (JP)

(72) Inventors: Toshiki Sayama, Chiyoda-ku (JP); Ryuta Sonoda, Chiyoda-ku (JP); Koji Ikawa, Chiyoda-ku (JP)

(73) Assignee: AGC Inc., Chiyoda-ku (JP)

( * ) Notice: Subject to any disclaimer, the term of this patent is extended or adjusted under 35 U.S.C. 154(b) by 0 days.

(21) Appl. No.: 15/468,148

(22) Filed: Mar. 24, 2017

(65) Prior Publication Data

US 2017/0194692 A1 Jul. 6, 2017

Related U.S. Application Data

(63) Continuation of application No. PCT/JP2015/078058, filed on Oct. 2, 2015.

(30) Foreign Application Priority Data

Oct. 2, 2014 (JP) ..... 2014-204100

(51) Int. Cl.
*H01Q 1/24* (2006.01)
*H01Q 5/385* (2015.01)
(Continued)

(52) U.S. Cl.
CPC ..... *H01Q 1/241* (2013.01); *H01Q 1/243* (2013.01); *H01Q 1/48* (2013.01); *H01Q 5/378* (2015.01);
(Continued)

(58) Field of Classification Search
CPC ..... H01Q 1/243; H01Q 1/38; H01Q 9/0421; H01Q 1/42; H01Q 1/12
(Continued)

(56) References Cited

U.S. PATENT DOCUMENTS 8,847,828 B1 9/2014 Lee et al.
9,048,528 B1 6/2015 Lee et al.
(Continued)

FOREIGN PATENT DOCUMENTS

CN 1496595 A 5/2004
CN 1507113 A 6/2004
(Continued)

OTHER PUBLICATIONS

International Search Report dated Nov. 17, 2015 in PCT/JP2015/078058, filed on Oct. 2, 2015 (with English translation).
(Continued)

*Primary Examiner* — Dameon E Levi
*Assistant Examiner* — Collin Dawkins
(74) *Attorney, Agent, or Firm* — Oblon, McClelland, Maier & Neustadt, L.L.P.

(57) ABSTRACT

An antenna device includes a ground plane; a first resonator extending in a direction at a distance from the ground plane and connected to a feeding point; and a second resonator arranged at a distance from the first resonator. The ground plane includes an edge portion formed along the second resonator, with a resonance current being formed on the first resonator and the ground plane. The second resonator is configured to function as a radiation conductor by resonance of the first resonator. A tip portion of the first resonator is located near a metallic part. The second resonator has a plurality of electrical lengths of differing resonance frequencies.

20 Claims, 11 Drawing Sheets

(51) Int. Cl.

| | |
|---|---|
| ***H01Q 5/392*** | (2015.01) |
| ***H01Q 1/48*** | (2006.01) |
| ***H01Q 9/04*** | (2006.01) |
| ***H01Q 9/42*** | (2006.01) |
| ***H01Q 5/378*** | (2015.01) |

(52) U.S. Cl.
CPC ..... *H01Q 5/385* (2015.01); *H01Q 5/392* (2015.01); *H01Q 9/0421* (2013.01); *H01Q 9/42* (2013.01)

(58) Field of Classification Search
USPC ..... 343/702, 872, 878, 700 MS
See application file for complete search history.

(56) References Cited

U.S. PATENT DOCUMENTS

2004/0066341 A1 4/2004 Ito et al.
2004/0080457 A1* 4/2004 Guo ..... H01Q 1/243 343/700 MS
2012/0249393 A1* 10/2012 Hotta ..... H01Q 1/243 343/843
2015/0130669 A1 5/2015 Sonoda et al.

FOREIGN PATENT DOCUMENTS

| | | |
|---|---|---|
| JP | 2003-198410 | 7/2003 |
| WO | WO 2005/069439 A1 | 7/2005 |
| WO | WO 2014/013840 A1 | 1/2014 |

OTHER PUBLICATIONS

Written Opinion dated Nov. 17, 2015 in PCT/JP2015/078058, filed on Oct. 2, 2015.
Andre Kurs et al. "Wireless Power Transfer via Strongly Coupled Magnetic Resonances", Science vol. 317, 2007, 4 pages.

* cited by examiner

ANTENNA DEVICE AND WIRELESS APPARATUS

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2015/078058 filed on Oct. 2, 2015 and designating the U.S., which claims priority of Japanese Patent Application No. 2014-204100 filed on Oct. 2, 2014. The entire contents of the foregoing applications are incorporated herein by reference.

BACKGROUND OF THE INVENTION

1. Field of the Invention

The disclosure herein generally relates to an antenna device and a wireless apparatus.

2. Description of the Related Art

Antenna devices including first resonators and second resonators arranged separated from the first resonators have been known. The second resonators function as radiation conductors according to resonances of the first resonators, and thereby the antenna devices function as multiband antennas (See, for example, WO 2014/013840).

SUMMARY OF THE INVENTION

It is a general object of at least one embodiment of the present invention to provide an antenna device and a wireless apparatus that substantially obviate one or more problems caused by the limitations and disadvantages of the related art.

According to an aspect of the present invention, an antenna device includes a ground plane; a first resonator extending in a direction at a distance from the ground plane and connected to a feeding point; and a second resonator arranged at a distance from the first resonator. The ground plane includes an edge portion formed along the second resonator, and a resonance current is formed on the first resonator and the ground plane. The second resonator is configured to function as a radiation conductor by resonance of the first resonator. A tip portion of the first resonator is located near a metallic part. The second resonator has a plurality of electrical lengths with differing resonance frequencies.

BRIEF DESCRIPTION OF THE DRAWINGS

Other objects and further features of embodiments will become apparent from the following detailed description when read in conjunction with the accompanying drawings, in which.

DETAILED DESCRIPTION OF THE PREFERRED EMBODIMENTS

In the following, an embodiment of the present invention will be described with reference to the accompanying drawings.

Figure 1:
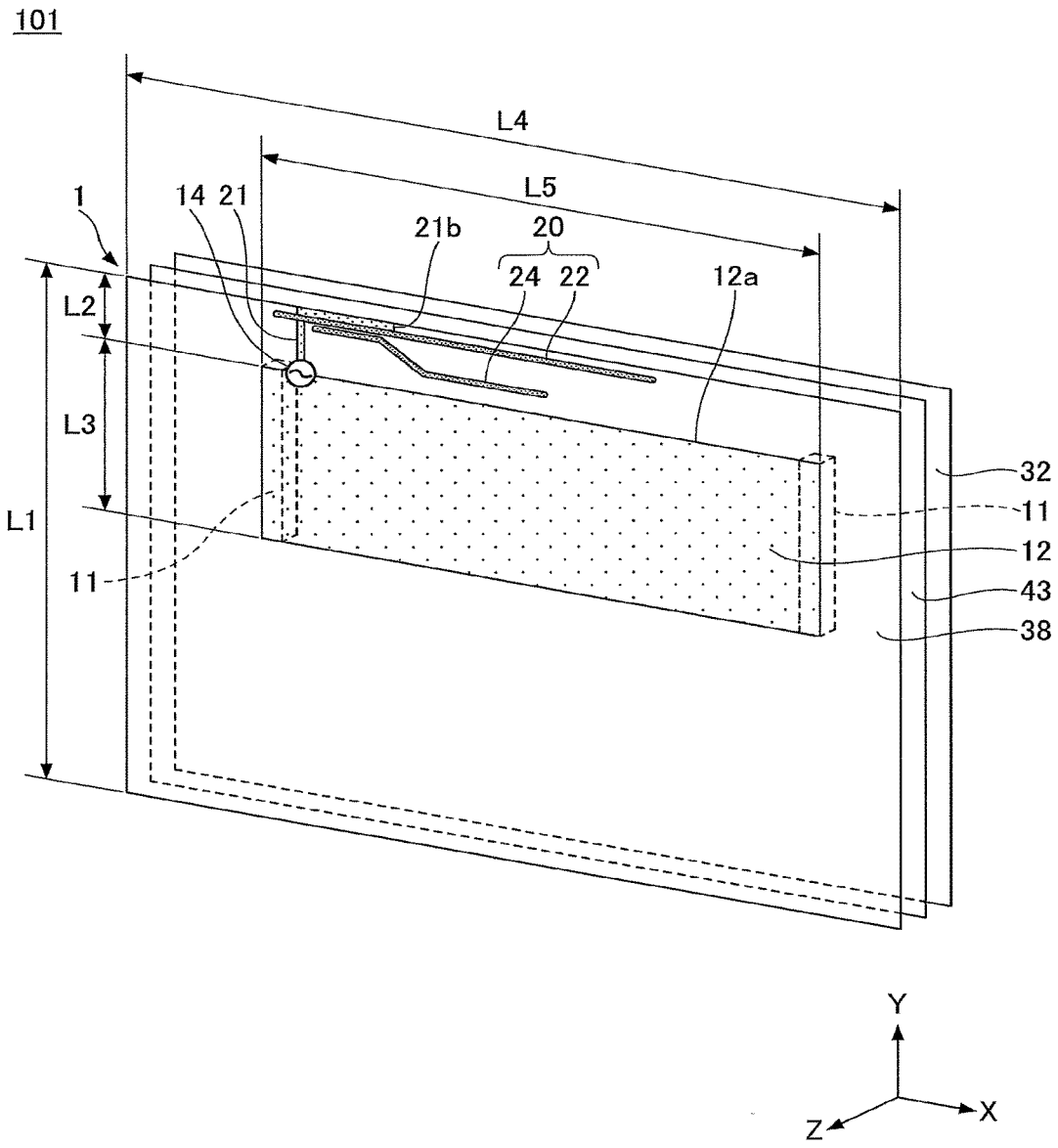
FIG. 1 is a perspective view depicting an example of an analysis model for an antenna device installed in a wireless apparatus according to an embodiment.

FIG. 1 is a perspective view depicting an example of a simulation model on a computer for analyzing an operation of an antenna device 1 installed on a wireless apparatus 101. As an electromagnetic field simulator, Microsoft Studio (Trademark Registered) manufactured by CST Computer Simulation Technology AG, is used.

The wireless apparatus 101 is a mobile object itself or a wireless communication apparatus installed on a mobile object. The mobile object includes specifically a portable mobile terminal apparatus, a vehicle such as a car, a robot, or the like. The mobile terminal apparatus includes specifically electronic equipment such as a mobile phone, a smartphone, a table computer, a gaming machine, a television, or a music or movie player. The wireless terminal 101 includes, for example, a base substance 38, a metal plate 32 and an antenna device 1.

In order to enhance visibility of the antenna device 1 in the drawing, for convenience, in FIG. 1, a ground plane 12, a feeding point 14, a feeding element 21 and an antenna element 20 are illustrated with solid lines.

The base substance 38 is an element configuring the wireless apparatus 101, is, for example, a member having a part formed in a shape of a plate. The base substance 38 may be an element configuring the antenna device 1. A specific example of the base substance 38 includes a housing, a cover or a substrate. When the base substance 38 is a housing, the base substance 38 is a member forming a part or a whole of an outer shape of the wireless apparatus 101, and is a storage unit for storing the antenna device 1 and the metal plate 32. When the base substance 38 is a cover, the base substance 38 is a member forming a part or a whole of an outer shape of the wireless apparatus 101, and is a back cover for covering the antenna device 1 from a side opposite to the metal plate 32. When the base substance 38 is a substrate, the base substance 38 is, for example, a member incorporated in the wireless apparatus 101, and is an insulator substrate consisting primarily of dielectric substance or the like.

The metal plate 32 is an example of a metal part located near the tip portion 21*b* of the feeding element 21, and is, for example, a plate-shape conductor installed in the wireless apparatus 101. The metal plate 32 may be a foil-shape conductor formed in a shape of a foil. A specific example of the metal plate 32 includes a display or a shield plate arranged in the wireless apparatus 101. The display is an apparatus for displaying an image (e.g. a liquid crystal display apparatus). The shield plate is a member for shielding noise.

The antenna device 1 feeds power to multiple radiating elements by a single feeding element. Using multiple radiating elements makes it possible to provide a multiband or wideband antenna device, and to control the directivity of an antenna device. The antenna device 1 is a multiband antenna that is excited in a plurality of different frequencies obtained by adding a frequency, at which a first radiating element 22 resonates, and a frequency, at which a second radiating element 24 resonates.

The antenna device 1 includes a ground plane 12, a feeding element 21, and an antenna element 20. The antenna element 20 includes multiple radiating elements (for illustration in the drawings, two radiating elements 22, 24).

The ground plane 12 is a conductor pattern having a shape of a plane. In the drawings, a ground plane 12 having a shape of a rectangle and extending in the X-Y plane is illustrated by an example. The ground plane 12 includes, for example, a pair of outer edge portions extending linearly in the X-axis direction, and a pair of outer edge portions extending linearly in the Y-axis direction. The ground plane 12, for example, arranged parallel to the X-Y plane, has a rectangular shape with a horizontal length parallel to the X-axis direction L5 and a vertical length parallel to the Y-axis direction L3.

The ground plane 12 is, for example, arranged on the substrate 43. The substrate 43 is one of the elements configuring the antenna device 1 or the wireless apparatus 101. The substrate 43 is a member arranged between the base substance 38 and the metal plate 32. The ground plate 12 may be connected to the metal plate 32 to enable conduction in terms of direct current via one or a plurality of connection members 11. The connection member 11 may also be a means for fixing or supporting the substrate 43, on which a ground plane 12 is provided, onto the metal plate 32.

Figure 2:
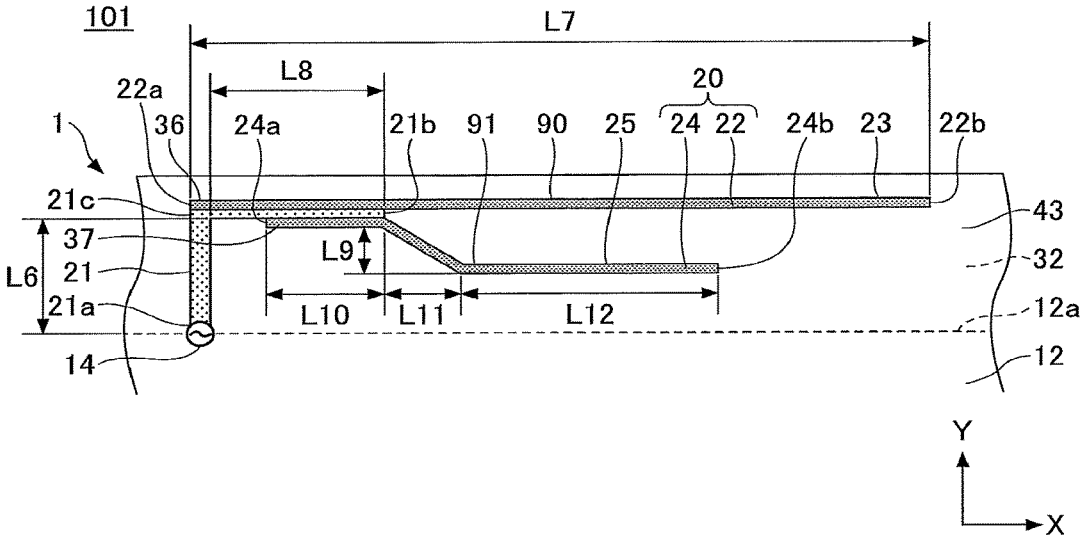
FIG. 2 is a front view partially depicting an example of the analysis model illustrated in FIG. 1.

FIG. 2 is a front view illustrating an example of the partially enlarged analysis model illustrated in FIG. 1. The antenna device 1 includes a ground plane 12, a feeding element 21, and an antenna element 20.

The feeding element 21 is an example of a first resonator that extends in a direction at a distance from the ground plane and is connected to a feeding point 14 with the ground plane as a ground reference. The feeding element 21 is a linear conductor that is connected to the antenna element 20 contactlessly for high frequency and can supply power to the antenna element 20. In the drawing, the feeding element 21 formed in an L shape by a linear conductor extending orthogonally from the outer edge portion 12*a* of the ground plane 12 and in a direction parallel to the Y-axis, and a linear conductor extending parallel to the outer edge portion 12*a* that is parallel to the X-axis, is illustrated. For illustration in the drawing, the feeding element 21, beginning at the feeding point 14, extends from an end portion 21*a* in the Y-axis direction, bends at a bending portion 21*c* to the X-axis direction, and extends in the X-axis direction to the tip portion 21*b*. The tip portion 21*b* is an open end to which other conductors are not connected. In the drawing, the feeding element 21 having the L-shape is illustrated by an example, but the shape of the feeding element 21 may be another shape such as a linear shape, or a meander shape.

The feeding point 14 is a feeding site which is connected to a predetermined transmission line using the ground plane 12, a feeding line, or the like. A specific example of the predetermined transmission line includes a micro strip line, a strip line, a coplanar waveguide with a ground plane (a coplanar waveguide, in which a ground plane is arranged on a surface opposite to the conductor surface), or the like. A specific example of the feeding line includes a feeder line, or a coaxial cable.

The antenna element 20 is an example of a second resonator which is arranged at a distance from a first resonator, and functions as a radiation conductor according to the resonance of the first resonator. The antenna element 20, illustrated in the drawings, is arranged at a distance from the feeding element 21, and functions as a radiation conductor by the resonance of the feeding element 21. The antenna element 20 is, for example, fed with power by electromagnetic field coupling with the feeding element 21, and functions as a radiation conductor.

The antenna element includes a radiating element 22 and a radiating element 24 that are arranged at a distance from each other. The radiating element 22 and the radiating element 24 have electrical lengths, of which the resonance frequencies differ from each other. The radiating element 22 is a linear conductor having a feeding portion 36 that receives power from the feeding element 21 contactlessly. The radiating element 24 is a linear conductor having a feeding portion 36 that receives power from the feeding element 21 contactlessly.

The radiating element 22 has a conductor portion 23 that extends in the X-axis direction along the outer edge portion 12*a*. The conductor portion 23 is arranged to be more distant from the outer edge portion 12*a* than a conductor portion 25 of the radiating element 24. In the drawings, the radiating element 22 having a linear shape is illustrated by an example, but the shape of the radiating element 22 may be another shape such as an L shape or a meander shape.

The radiating element 24 has the conductor portion 25, which is arranged at a distance from the outer edge portion 12*a*, and extends in the X-axis direction along the outer edge portion 12*a*. In the drawings, the radiating element 24 has a shape that bends at two sites, but the shape of the radiating element 24 may be another shape such as a linear shape, an L shape or a meander shape.

Because the radiating element 22 has the conductor portion 23 along the outer edge portion 12*a*, or the radiating element 24 has the conductor portion 25 along the outer edge portion 12*a*, for example, directivity of the antenna device 1 can be easily adjusted. Moreover, because the radiating element 22 has the conductor portion 23 that extends along the conductor portion 25 of the radiating element 24, the antenna device 1 can be made smaller, compared with a configuration in which the conductor portion 23 does not extend along the conductor portion 25. For example, the radiating element 22 has a conductor portion 23 that extends parallel to the conductor portion 25 that extends in the direction parallel to the X-axis.

The radiating elements 22, 24 and the feeding element 21 may be overlapped or not overlapped in a planar view in any direction such as an X-axis direction, Y-axis direction or Z-axis direction, as long as the feeding element 21 is separated from the radiating elements 22, 24 by a distance with which contactless power feeding can be performed.

The feeding element 21 and the radiating elements 22, 24 are, for example, arranged separately from each other by a distance with which the electromagnetic field coupling can be performed to each other. The radiating element 22 has a feeding portion 36 that receives power from the feeding element 21. The radiating element 22 is fed power contactlessly by the electromagnetic field coupling via the feeding element 21 at the feeding portion 36. By receiving power in this way, the radiating element 22 functions as a radiation conductor of the antenna device 1. The same applies to the radiating element 24 also.

As illustrated in the drawings, when the radiating element 22 is a linear conductor connecting two points, a resonance current (electric current distributed in a stationary wave shape) which is the same as in a half-wave dipole antenna is formed on the radiating element 22. That is, the radiating element 22 functions as a dipole antenna that resonates at a half wavelength of a predetermined frequency (in the following, referred to as a dipole mode). The same applies to the radiating element 24 also.

Moreover, although not illustrated in the drawings, the radiating element 22 may be a loop-shaped conductor, which is a linear conductor and forms a rectangle. When the radiating element 22 is the loop-shaped conductor, a resonance current (electric current distributed in a stationary wave shape) which is the same as in a loop antenna is formed on the radiating element 22. That is, the radiating element 22 functions as a loop antenna that resonates at a wavelength of a predetermined frequency (in the following, referred to as a loop mode). The same applies to the radiating element 24 also.

Moreover, although not illustrated in the drawings, the radiating element 22 may be a linear conductor that is connected to a ground level of the feeding point 14. The ground level of the feeding point 14 is, for example, a ground plane 12, a conductor connected to the ground plane 12 to enable conduction in terms of direct current, or the like. For example, an end portion 22*b* of the radiating element 22 is connected to the outer edge portion 12*a* of the ground plane 12. When the radiating element 22 is a linear conductor having one end connected to the ground level of the feeding point 14 and the other end being an open end, a resonance current (electric current distributed in a stationary wave shape) which is the same as in a $\lambda/4$ monopole antenna is formed on the radiating element 22. That is the radiating element 22 functions as a monopole antenna that resonates at a quarter of a wavelength of a predetermined frequency (in the following, referred to as a monopole mode). The same applies to the radiating element 24 also.

An electromagnetic field coupling is a coupling using a resonance phenomenon of an electromagnetic field. For example, the electromagnetic field coupling is disclosed in A. Kurs, et al., "Wireless Power Transfer via Strongly Coupled Magnetic Resonances", Science Express, Vol. 317, No. 5834, pp. 83-86, July 2007. The electromagnetic field coupling is also referred to as an electromagnetic field resonant coupling or an electromagnetic field resonance coupling. The electromagnetic field coupling is a technique of arranging resonators resonating at the same frequency close to each other, and transferring energy from one resonator to the other resonator via a coupling in a near field (non-radiation field region) generated between the resonators when the one resonator resonates. Moreover, the electromagnetic field coupling means a coupling of an electric field and a magnetic field at high frequencies where an electrostatic capacitance coupling or a coupling by an electromagnetic induction is removed. Here, the phrase "an electrostatic capacitance coupling or a coupling by an electromagnetic induction is removed." does not mean that these couplings are completely absent, but means that these couplings are small to the extent that the couplings have no influence. A medium between the feeding element 21 and the radiating elements 22, 24 may be air or dielectric material such as a glass or a resin material. In addition, a conductive material, such as a ground plane or a display, is preferably not arranged between the feeding element 21 and the radiating elements 22, 24.

By performing the electromagnetic field coupling between the feeding element 21 and the radiating elements 22, 24, a strong structure against shock can be obtained. That is, by using the electromagnetic field coupling, power can be fed to the radiating elements 22, 24 using the feeding element 21 without bringing the feeding element 21 into physical contact with the radiating elements 22, 24, and thereby a stronger structure against shock, than a contact feeding method that requires a physical contact, can be acquired.

According to the electromagnetic field coupling between the feeding element 21 and the radiating elements 22, 24, a contactless feeding is enabled with a simple configuration. That is, by using the electromagnetic field coupling, power can be fed to the radiating elements 22, 24 using the feeding element 21 without bringing the feeding element 21 into physical contact with the radiating elements 22, 24, and thereby a feeding is enabled with a simpler configuration than a contact feeding method that requires a physical contact. Moreover, by using the electromagnetic field coupling, power can be fed to the radiating elements 22, 24 using the feeding element 21 without configuring an unnecessary part such as a capacitance plate, and thereby a feeding is enabled with a simpler configuration than a case of feeding by an electrostatic capacitance coupling.

Moreover, in a case of feeding by the electromagnetic field coupling, compared with the case of feeding by the electrostatic capacitance coupling or a magnetic field coupling, an operation gain (antenna gain) does not tend to decrease even when a separation distance (coupling distance) between the feeding element 21 and the radiating elements 22, 24 is made longer. Here, the operation gain is a quantity obtained as a product of a radiation efficiency of the antenna and a return loss, and is a quantity defined as an efficiency of the antenna to input power. Therefore, according to the electromagnetic field coupling between the feeding element 21 and the radiating elements 22, 24, a degree of freedom of determining arrangement positions of the feeding element 21 and the radiating elements 22, 24 can be enhanced, and positioning robustness also can be enhanced. The high positioning robustness means that deviation of the arrangement positions or the like of the feeding element 21 and the radiating elements 22, 24 little affects the operation gain of the radiating elements 22, 24. Moreover, because the degree of freedom of determining the arrangement positions of the feeding element 21 and radiating elements 22, 24 is high, it is advantageous that a space required for installing the antenna device 1 can be easily reduced.

Moreover, in the case illustrated in the drawings, the feeding portion 36 that is a site where the feeding element 21 feeds power to the radiating element 22 is located at a site between the one end portion 22*a* of the radiating element 22 and the other end portion 22*b* that does not include the central portion 90 (a site between the central portion 90 and the end portion 22*a*, or a site between the central portion 90 and the other end portion 22*b*). In this way, by locating the feeding portion 36 at a site of the radiating element 22 other than the portion that gives the lowest impedance at a resonance frequency of a fundamental mode of the radiating element 22 (In this case, the central portion 90), a matching of the antenna device 1 can be easily obtained. The feeding portion 36 is a site defined as the portion which is nearest to the feeding point 14, within the conductor portion of the radiating element 22 in which the radiating element 22 and the feeding element 21 are closest to each other.

Moreover, in the case illustrated in the drawings, the feeding portion 37 that is a site where the feeding element 21 feeds power to the radiating element 24 is located at a site between the one end portion 24*a* of the radiating element 24 and the other end portion 24*b* that does not include the central portion 91 (a site between the central portion 91 and the end portion 24*a*, or a site between the central portion 91 and the other end portion 24*b*). In this way, by locating the feeding portion 37 at a site of the radiating element 24 other than the portion that gives the lowest impedance at a resonance frequency of a fundamental mode of the radiating element 24 (In this case, the central portion 91), a matching of the antenna device 1 can be easily obtained. The feeding portion 37 is a site defined as the portion which is nearest to the feeding point 14, within the conductor portion of the radiating element 24 in which the radiating element 24 and the feeding element 21 are closest to each other.

In the case of the dipole mode, the impedance in the radiating element 22 increases, as the site is separated from the central portion 90 of the radiating element 22 toward the end portion 22*a* or the end portion 22*b*. In the case of a coupling at a high impedance in the electromagnetic field coupling, while the impedance between the feeding element 21 and the radiating element 22 might vary to some extent, the impedance matching is little affected as long as the coupling is performed at a high impedance above a certain level. Therefore, in order to easily obtain the matching, the feeding portion 36 of the radiating element 22 is preferably located at a portion of high impedance in the radiating element 22. In the same way, in order to easily obtain the matching, the feeding portion 37 of the radiating element 24, in the case of the dipole mode, is preferably located at a portion of high impedance in the radiating element 24.

In the case of the dipole mode, for example, in order to easily obtain the impedance matching of the antenna device 1, the feeding portion 36 is preferably located at a site, which is separated from a site that gives the lowest impedance at the resonance frequency of the fundamental mode of the radiating element 22 (in this case, the central portion 90) by one eighth of the entire length of the radiating element 22 or more (preferably one sixth or more, further preferably a quarter or more). The same applies to the feeding portion 37 also. In the case illustrated in the drawings, the entire length of the radiating element 22 corresponds to L7. The feeding portion 36 is located on the end portion 22*a* side with respect to the central portion 90. The entire length of the radiating element 24 corresponds to $L10+\sqrt{(L9^2+L11^2)}+L12$. The feeding portion 37 is located on the end portion 24*a* side with respect to the central portion 91. The entire length of the radiating element 22 is greater than the entire length of the radiating element 24.

In the case of the loop mode, for example, in order to easily obtain the impedance matching of the antenna device 1, the feeding portion 36 is preferably located at a site, which is separated from a site that gives the lowest impedance at the resonance frequency of the fundamental mode of the radiating element 22 by one sixteenth of a length of a perimeter on the inner periphery side of the loop of the radiating element 22 or less (preferably one twelfth, further preferably one eighth). The same applies to the radiating element 24 also.

In the case of the monopole mode, where the end portion 22*b* is connected to the ground level of the feeding point 14, the feeding portion 36, which is a site where the feeding element 21 feeds power to the radiating element 22 is located at a site, is closer to the end portion 22*a* side with respect to the portion (in this case, the end portion 22*b*) that gives the lowest impedance at the resonance frequency of the fundamental mode of the radiating element 22, and thereby the impedance matching of the antenna device 1 can be easily obtained. Especially, the feeding portion 36 is preferably located on the end portion 21*a* side with respect to the central portion 90. The same applies to the feeding portion 37 also.

In the case of the monopole mode, where the end portion 22*b* is connected to the ground level of the feeding point 14, the impedance in the radiating element 22 increases with approaching from the end portion 22*b* of the radiating element 22 to the end portion 22*a*. In the case of the coupling at a high impedance in the electromagnetic field coupling, while the impedance between the feeding element 21 and the radiating element 22 might vary to some extent, the impedance matching is little affected as long as the coupling is performed at a high impedance above a certain level. Therefore, in order to easily obtain the matching, the feeding portion 36 of the radiating element 22 is preferably located at a position of high impedance in the radiating element 22. The same applies to the feeding portion 37 also.

In the case of the monopole mode, where the end portion 22*b* is connected to the ground level of the feeding point 14, for example, in order to obtain easily the impedance matching of the antenna device 1, the feeding portion 36 is preferably located at a site, which is separated from the site that gives the lowest impedance at the resonance frequency of the fundamental mode of the radiating element 22 (in this case, the end portion 22*b*) by a quarter of the entire length of the radiating element 22 or more (preferably one third or more, more preferably a half or more), further preferably a site on the end portion 22*a* side with respect to the central portion 90. The same applies to the feeding portion 37 also.

Moreover, when a wavelength of an electric wave in vacuum at the resonance frequency of the fundamental mode of the radiating element 22 is denoted by $\lambda_{01}$, the shortest distance D11 between the feeding portion 36 and the ground plane 12 is $0.0034\lambda_{01}$ or more but $0.21\lambda_{01}$ or less. The shortest distance D11 is more preferably $0.0043\lambda_{01}$ or more but $0.199\lambda_{01}$ or less, and further preferably $0.0069\lambda_{01}$ or more but $0.164\lambda_{01}$ or less. Setting the shortest distance D11 in the above-described region has an advantage of improving the operation gain of the radiating element 22. Moreover, because the shortest distance D11 is less than $(\lambda_{01}/4)$, the antenna device 1 does not generate a circular polarized wave, but generates a linearly polarized wave. The same applies to a relation between a wavelength $\lambda_{02}$ of an electric wave in vacuum at the resonance frequency of the fundamental mode of the radiating element 24 and the shortest distance D12 between the feeding portion 37 and the ground plane 12 also.

The shortest distance D11 corresponds to a distance obtained by connecting, by a straight line, closest parts of the feeding portion 36 and the outer edge portion 12*a*, and the shortest distance D12 corresponds to a distance obtained by connecting, by a straight line, closest parts of the feeding portion 37 and the outer edge portion 12*a*. The outer edge portion 12*a* in this case is an outer edge portion of the ground plane 12 that is a ground level of the feeding point 14 connected to the feeding element 21 which feeds power to the feeding portions 36, 37. Moreover, the radiating elements 22, 24 and the ground plane 12 may be on the same plane, and may be on different planes. Moreover the radiating elements 22, 24 may be arranged on a plane parallel to a plane on which the ground plane 12 is arranged, or may be on a plane that intersects with the plane on which the ground plane 12 is arranged at an optional angle.

Moreover, when a wavelength of an electric wave in vacuum at the resonance frequency of the fundamental mode of the radiating element 22 is denoted by $\lambda_{01}$, the shortest distance D21 between the feeding element 21 and the radiating element 22 is preferably $0.2\times\lambda_{01}$ or less (more preferably, $0.1\times\lambda_{01}$ or less, further preferably $0.05\times\lambda_{01}$ or less). Arranging the feeding element 21 and the radiating element 22 separated from each other by the shortest distance D21, as described above, has an advantage of improving the operation gain of the radiating element 22. The same applies to a relation between a wavelength $\lambda_{02}$ of an electric wave in vacuum at the resonance frequency of the fundamental mode of the radiating element 24 and the shortest distance D22 between the feeding element 21 and the radiating element 22 also. Moreover, the above-described arrangement also has an advantage of wide banding the frequency band width, at which the antenna device 1 operates, when the shortest distance D21 is almost the same as the shortest distance D22.

The shortest distance D21 corresponds to a distance obtained by connecting, by a straight line, closest parts of the feeding element 21 and the radiating element 22, and the shortest distance D12 corresponds to a distance obtained by connecting, by a straight line, closest parts of the feeding element 21 and the radiating element 24. Moreover, the feeding elements 21 and the radiating elements 22, 24 may intersect with each other or may not intersect with each other viewed from an optional direction, as long as the feeding element 21 and the radiating elements 22, 24 are in a state of electromagnetic field coupling. Furthermore, the intersection angle may be an optional angle. Moreover, the radiating element 22, 24 and the feeding element 21 may be on the same plane, and may be on different planes. Moreover the radiating elements 22, 24 may be arranged on a plane parallel to a plane on which the feeding element 21 is arranged, or may be on a plane that intersects with the plane on which the feeding element 21 is arranged with an optional angle.

Moreover, a distance that the feeding element 21 and the radiating element 22 run parallel to each other at the shortest distance D21 is, in the case of the dipole mode, preferably three eighths of a physical length of the radiating element 22 or less. The distance is more preferably a quarter of the length or less, and further preferably one eighth of the length or less. In the case of the loop mode, the distance is preferably three sixteenths of a length of a perimeter on the inner periphery side of the loop of the radiating element 22 or less. The distance is more preferably one eighth of the length or less, and further preferably one sixteenth of the length or less. In the case of the monopole mode, the distance is preferably three quarters of the physical length of the radiating element 22 or less. The distance is more preferably a half of the length or less, and further preferably one quarter of the length or less. The same applies to a distance for which the feeding element 21 and the radiating element 24 run parallel to each other at the shortest distance D22 also.

Positioning that gives the shortest distance D21 is a site where the coupling between the feeding element 21 and the radiating element 22 is strong. When the distance of running parallel to each other along the shortest distance D21 is long, because the feeding element 21 couples to both a portion of high impedance in the radiating element 22 and a portion of low impedance in the radiating element 22, the impedance matching may not be obtained. Therefore, because the feeding element 21 strongly couples only to a site where a variation of the impedance in the radiating element 22 is small, a short distance of running parallel to each other along the shortest distance D21 has an advantage of obtaining an impedance matching. Similarly, a short distance of running parallel to each other along the shortest distance D22 has an advantage of obtaining an impedance matching.

Moreover, the electrical length giving the fundamental mode of the resonance of the feeding element 21 is denoted by Le21, the electrical length giving the fundamental mode of the resonance of the radiating element 22 is denoted by Le22, the wavelength on the feeding element 21 or the radiating element 22 at the resonance frequency $f_{11}$ of the fundamental mode of the radiating element 22 is denoted by $\lambda_1$. When the fundamental mode of the resonance of the radiating element 22 is the dipole mode, Le21 is preferably $(3/8)\cdot\lambda_1$ or less, and Le22 is preferably $(3/8)\cdot\lambda_1$ or more but $(5/8)\cdot\lambda_1$ or less. When the fundamental mode of the resonance of the radiating element 22 is the loop mode, Le21 is preferably $(3/8)\cdot\lambda_1$ or less, and Le22 is preferably $(7/8)\cdot\lambda_1$ or more but $(9/8)\cdot\lambda_1$ or less. When the fundamental mode of the resonance of the radiating element 22 is the monopole mode, Le21 is preferably $(3/8)\cdot\lambda_1$ or less, and Le22 is preferably $(1/8)\cdot\lambda_1$ or more but $(3/8)\cdot\lambda_1$ or less.

Moreover, the electrical length giving the fundamental mode of the resonance of the feeding element 21 is denoted by Le21, the electrical length giving the fundamental mode of the resonance of the radiating element 24 is denoted by Le24, the wavelength on the feeding element 21 or the radiating element 24 at the resonance frequency $f_{12}$ of the fundamental mode of the radiating element 24 is denoted by $\lambda_2$. When the fundamental mode of the resonance of the radiating element 24 is the dipole mode, Le21 is preferably $(3/8)\cdot\lambda_2$ or less, and Le24 is preferably $(3/8)\cdot\lambda_2$ or more but $(5/8)\cdot\lambda_2$ or less. When the fundamental mode of the resonance of the radiating element 24 is the loop mode, Le21 is preferably $(3/8)\cdot\lambda_2$ or less, and Le24 is preferably $(7/8)\cdot\lambda_2$ or more but $(9/8)\cdot\lambda_2$ or less. When the fundamental mode of the resonance of the radiating element 24 is the monopole mode, Le21 is preferably $(3/8)\cdot\lambda_2$ or less, and Le24 is preferably $(1/8)\cdot\lambda_2$ or more but $(3/8)\cdot\lambda_2$ or less. Le24 is smaller than Le22.

Moreover, the ground plane 12 is famed so that the outer edge portion 12*a* is arranged along the radiating elements 22, 24. Then, the feeding element 21 can form a resonance current (electric current distributed in a stationary wave shape) on the feeding element 21 and the ground plane 12 according to an interaction with the outer edge portion 12*a*, and thereby resonates with the radiating elements 22, 24 to form the electromagnetic field coupling. Therefore, the electrical length of the feeding element 21 does not particularly have a lower limit value, and is required to be a length sufficient to physically form the electromagnetic field coupling between the feeding element 21 and the radiating elements 22, 24.

Moreover, in order to give a degree of freedom to the shape of the feeding element 21, the electrical length L21 is more preferably $(1/8)\cdot\lambda_1$ or more but $(3/8)\cdot\lambda_1$ or less or $(1/8)\cdot\lambda_2$ or more but $(3/8)\cdot\lambda_2$ or less, and is especially preferably $(3/16)\cdot\lambda_1$ or more but $(5/16)\cdot\lambda_1$ or less or $(3/16)\cdot\lambda_2$ or more but $(5/16)\cdot\lambda_2$ or less. When the electrical length L21 falls within the above-described range, the feeding element 21 resonates well with respect to the designed frequencies for the radiating elements 22, 24 (resonance frequencies $f_{11}$, $f_{12}$), the feeding element 21 and the radiating elements 22, 24 resonate independently of the ground plane 12, and good electromagnetic field coupling is obtained, and is preferable.

Moreover, in order to reduce the size of the antenna device 1, the electrical length Le21 of the feeding element 21 is preferably less than $(1/4)\cdot\lambda_1$ or less than $(1/4)\cdot\lambda_2$, and is especially preferably $(1/8)\cdot\lambda_1$ or less or $(1/8)\cdot\lambda_2$, or less.

To state that the electromagnetic field coupling is enabled means that the matching is achieved. Moreover, in this case, it is unnecessary to design the electrical length for the feeding element 21 in conformity to the resonance frequencies $f_{11}$, $f_{12}$ of the radiating elements 22, 24, and it becomes possible to design freely the feeding element 21 as a radiation conductor, and thereby multiplying frequency utilization for the antenna device 1 can be easily achieved.

The physical length L21 of the feeding element 21 (for illustration in the drawings, corresponds to L6+L8) is, when a matching circuit or the like is not included, determined by $\lambda_{g1}=\lambda_{01}\cdot k_1$, where $\lambda_{01}$ is a wavelength of an electric wave in vacuum at the resonance frequency of the fundamental mode of the radiating element 22, and $k_1$ is a shortening rate of a wavelength shortening effect by an implementation environment. Here, $k_1$ are values such as an effective specific permittivity ($\varepsilon_{r1}$), and an effective specific permeability ($\mu_{r1}$) that are calculated from a specific permittivity, a specific permeability, a thickness, a resonance frequency and the like of a medium (environment) of a dielectric base material or the like, on which the feeding element 21 is provided. That is, L21 is $(3/8)\cdot\lambda_{g1}$ or less. The shortening rate may be calculated from the above-described physical properties, or may be obtained experimentally. For example, the shortening rate may be obtained by measuring a resonance frequency of an element of interest and provided in an environment for measuring the shortening rate, measuring a resonance frequency of the same element in an environment, in which shortening rates for respective optional frequencies are already known, and calculating a difference between the above-described resonance frequencies.

The physical length L21 of the feeding element 21 is a physical length that gives the electrical length Le21, and is equal to Le21, in an ideal case that does not include other factors. When the feeding element 21 includes a matching circuit or the like, L21 is preferably greater than zero but less than or equal to Le21. The physical length L21 can be shortened (reducing the size) by using a matching circuit such as an inductor. L21 is less than the entire length of the radiating element 22 and the entire length of the radiating element 24.

When the fundamental mode of the resonance of the radiating element 22 is the dipole mode (a linear conductor such as the radiating element 22 having open ends on both ends), the electrical length Le22 is preferably $(3/8)\cdot\lambda_1$ or more but $(5/8)\cdot\lambda_1$ or less, more preferably $(7/16)\cdot\lambda_1$ or more but $(9/16)\cdot\lambda_1$ or less, and especially preferably $(15/32)\cdot\lambda_1$ or more but $(17/32)\cdot\lambda_1$ or less. Moreover, taking into account higher order mode, the Le22 is preferably $(3/8)\cdot\lambda_1\cdot m$ or more but $(5/8)\cdot\lambda_1\cdot m$ or less, more preferably $(7/16)\cdot\lambda_1\cdot m$ or more but $(9/16)\cdot\lambda_1\cdot m$ or less, and especially preferably $(15/32)\cdot\lambda_1\cdot m$ or more but $(17/32)\cdot\lambda_1\cdot m$ or less. The same applies to the relation between the electrical length Le24 and $\lambda_2$ also.

Note that, m is a mode number of the higher order mode, and is a natural number. The number m is preferably an integer from 1 to 5, and especially preferably an integer from 1 to 3. The mode with m=1 is the fundamental mode. When the electrical lengths Le22, Le24 fall within this range, the radiating element 22, 24 sufficiently function as radiation conductors, good efficiency of the antenna device 1 can be obtained, and is preferable.

Similarly, when the fundamental mode of the resonance of the radiating element 22 is the loop mode (the radiating element 22 is a loop-shaped conductor), the electrical length Le22 is preferably $(7/8)\cdot\lambda_1$ or more but $(9/8)\cdot\lambda_1$ or less, more preferably $(15/16)\cdot\lambda_1$ or more but $(17/16)\cdot\lambda_1$ or less, and especially preferably $(31/32)\cdot\lambda_1$ or more but $(33/32)\cdot\lambda_1$ or less. Moreover, taking into account higher order mode, the Le22 is preferably $(7/8)\cdot\lambda_1\cdot m$ or more but $(9/8)\cdot\lambda_1\cdot m$ or less, more preferably $(15/16)\cdot\lambda_1\cdot m$ or more but $(17/16)\cdot\lambda_1\cdot m$ or less, and especially preferably $(31/32)\cdot\lambda_1\cdot m$ or more but $(33/32)\cdot\lambda_1\cdot m$ or less. The same applies to the relation between the electrical length Le24 and $\lambda_2$ too. When the electrical lengths Le22, Le24 fall within this range, the radiating element 22, 24 sufficiently function as radiation conductors, good efficiency of the antenna device 1 can be obtained, and is preferable.

Similarly, when the fundamental mode of the resonance of the radiating element 22 is the monopole mode (the radiating element 22 is connected to the ground level of the feeding point 14, and has an open end), the electrical length Le22 is preferably $(1/8)\cdot\lambda_1$ or more but $(3/8)\cdot\lambda_1$ or less, more preferably $(3/16)\cdot\lambda_1$ or more but $(5/16)\cdot\lambda_1$ or less, and especially preferably $(7/32)\cdot\lambda_1$ or more but $(9/32)\cdot\lambda_1$ or less. The same applies to the relation between the electrical length Le24 and $\lambda_2$ also. When the electrical lengths Le22, Le24 fall within this range, the radiating element 22, 24 sufficiently function as radiation conductors, good efficiency of the antenna device 1 can be obtained, and is preferable.

The physical length L22 of the radiating element 22 is determined by $\lambda_{g2}=\lambda_{01}\cdot k_2$, where $\lambda_{01}$ is a wavelength of an electric wave in vacuum at the resonance frequency of the fundamental mode of the radiating element 22, and $k_2$ is a shortening rate of a wavelength shortening effect by an implementation environment. Here, $k_2$ are values such as an effective specific permittivity ($\varepsilon_{r2}$), and an effective specific permeability ($\mu_{r2}$) that are calculated from a specific permittivity, a specific permeability, a thickness, a resonance frequency and the like of a medium (environment) of a dielectric base material or the like, on which the radiating element 22 is provided. That is, when the fundamental mode of the resonance of the radiating element 22 is the dipole mode, L22 is ideally $(1/2)\cdot\lambda_{g2}$. The physical length L22 of the radiating element 22 is preferably $(1/4)\cdot\lambda_2$ or more but $(3/4)\cdot\lambda_2$ or less, further preferably $(3/8)\cdot\lambda_2$ or more but $(5/8)\cdot\lambda_2$ or less. When the fundamental mode of the resonance of the radiating element 22 is the loop mode, the physical length L22 of the radiating element 22 is $(7/8)\cdot\lambda_2$ or more but $(9/8)\cdot\lambda_2$ or less. When the fundamental mode of the resonance of the radiating element 22 is the monopole mode, the physical length L22 of the radiating element 22 is $(1/8)\cdot\lambda_2$ or more but $(3/8)\cdot\lambda_2$ or less. The same applies to a relation between the physical length L24 of the radiating element 24 and a wavelength $\lambda_{02}$ of an electric wave in vacuum at the resonance frequency of the fundamental mode of the radiating element 24 also.

The physical length L22 of the radiating element 22 is a physical length that gives the electrical length Le22, and is equal to Le22, in an ideal case that does not include other factors. Even if L22 is shortened by using a matching circuit such as an inductor, L22 is preferably greater than zero but less than or equal to Le22, and is especially preferably 0.4 times Le22 or more but Le22 or less. Adjusting the length L22 of the radiating element 22 to the above-described length has an advantage of improving the operation gain of the radiating element 22. The same applies to the physical length L24 of the radiating element 24 also.

Moreover, in the case where an interaction between the feeding element 21 and the outer edge portion 12*a* of the ground plane 12 can be used, as illustrated in the drawings, the feeding element 21 may be caused to function as a radiation conductor. The radiating element 22 is a radiation conductor that is fed power contactlessly according to the electromagnetic field coupling at the feeding portion 36 by the feeding element 21, and thereby functions as a $\lambda/2$ dipole antenna. The radiating element 24 is also a radiation conductor that is fed power contactlessly according to the electromagnetic field coupling at the feeding portion 37 by the feeding element 21, and thereby functions as, for example, a $\lambda/2$ dipole antenna. The feeding element 21 is a feeding conductor having a linear shape that can feed power to the radiating elements 22, 24. The feeding element 21 is also a radiation conductor that is fed power at the feeding point 14, and thereby functions as a monopole antenna (e.g. a $\lambda/4$ monopole antenna). When the resonance frequency of the radiating element 22, the resonance frequency of the radiating element 24, and the resonant frequency of the feeding element 21 are set to $f_{11}$, $f_{12}$, and $f_2$, respectively, and the length of the feeding element 21 is adjusted so that the feeding element 21 resonates at the frequency $f_2$, as a monopole antenna, the radiation function of the feeding element 21 can be used, multiple frequency utilization for the antenna device 1 can be achieved easily.

The physical length L21 of the feeding element 21 upon using the radiation function of the feeding element 21 is, when a matching circuit or the like is not included, determined by $\lambda_{g3}=\lambda_3 \cdot k_1$, where $\lambda_3$ is a wavelength of an electric wave in vacuum at the resonance frequency $f_2$ of the feeding element 21, and $k_1$ is a shortening rate of a shortening effect by an implementation environment. Here, $k_1$ are values such as an effective specific permittivity ($\varepsilon_{r1}$) and an effective specific permeability ($\mu_{r1}$) of the environment of the feeding element 21 that are calculated from a specific permittivity, a specific permeability, a thickness, a resonance frequency and the like of a medium (environment) of a dielectric base material or the like, on which the feeding element 21 is provided. That is, L21 is $(1/8)\cdot\lambda_{g3}$ or more but $(3/8)\cdot\lambda_{g3}$ or less, and preferably $(3/16)\cdot\lambda_{g3}$ or more but $(5/16)\cdot\lambda_{g3}$ or less.

The antenna device 1 can function as a multiband antenna in which the radiating element 22 resonates at the resonance frequency $f_{11}$ of the fundamental mode (first order mode), and the radiating element 24 resonates at the resonance frequency $f_{12}$ of the fundamental mode (first order mode). Moreover, the antenna device 1 can also function as a multiband antenna in which the radiating element 22 uses a second order mode for resonating at a resonance frequency $f_{112}$ that is about twice the resonance frequency $f_{11}$, and the radiating element 24 uses a second order mode for resonating at a resonance frequency $f_{122}$ that is about twice the resonance frequency $f_{12}$. That is, the antenna device 1 can function as a multiband antenna that resonates at four resonance frequencies $f_{11}$, $f_{112}$, $f_{12}$, and $f_{122}$.

The resonance frequency of the fundamental mode of the feeding element is denoted by $f_{21}$, the resonance frequency of the second order mode of the radiating elements is denoted by $f_{32}$, the wavelength in vacuum at the resonance frequency of the fundamental mode of the radiating elements is denoted by $\lambda_0$, and a value of the shortest distance between the feeding element and the radiating elements normalized by $\lambda_0$ is denoted by x. Then, according to the antenna device of the embodiment, when a frequency ratio p ($=f_{21}/f_{32}$) is 0.7 or more but ($0.1801\cdot x^{-0.468}$) or less, a favorable matching at the resonance frequency of the fundamental mode of the radiating element and at the resonance frequency of the second order mode can be achieved.

For example, in the case of the antenna device 1, where the resonance frequency of the fundamental mode of the feeding element 21 is denoted by $f_{21}$ and the resonance frequency of the second order mode of the radiating element 22 is denoted by $f_{112}$, when the frequency ratio p ($f_{21}/f_{112}$) is 0.7 or more but ($0.1801\cdot x^{-0.468}$) or less, a favorable matching at the resonance frequency of the fundamental mode of the radiating element 22 and at the resonance frequency of the second order mode can be achieved. The same applies to the radiating element 24 also.

Figure 3:
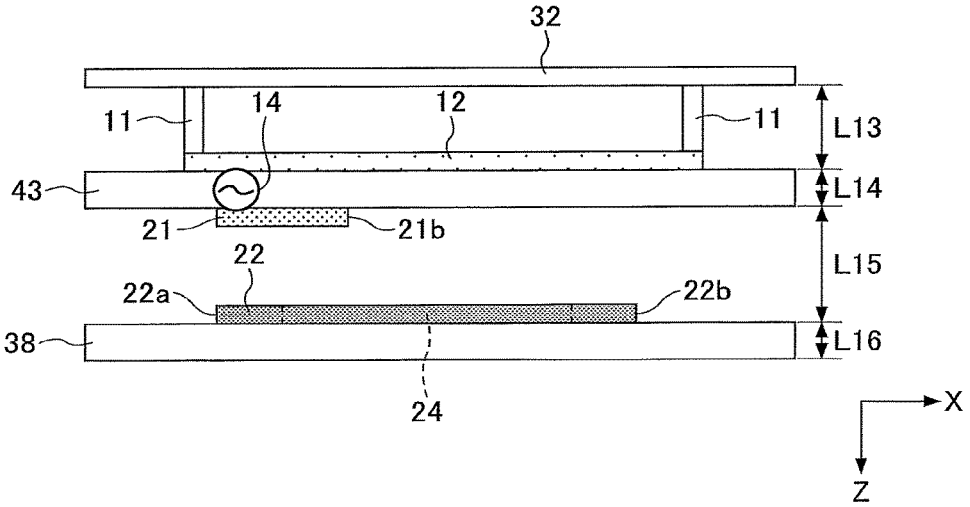
FIG. 3 is a diagram depicting an example of a positional relationship among respective configurations of the wireless apparatus and the antenna device.

FIG. 3 schematically illustrates a positional relationship of the respective components of the antenna device 1 in the Z-axis direction (positional relationship in a height direction parallel to the Z-axis). At least two of the feeding element 21, the radiating element 22, the radiating element 24, and the ground plane 12 may be conductors having parts arranged at different heights from each other, or may be conductors having parts arranged at the same height.

The feeding element 21 is arranged on a surface of the substrate 43 facing the radiating elements 22, 24. However, the feeding element 21 may be arranged on a surface of the substrate 43 opposite to the surface facing the radiating elements 22, 24. The feeding element 21 may be arranged on a side surface of the substrate 43. The feeding element 21 may be arranged inside the substrate 43. The feeding element 21 may be arranged on a member other than the substrate 43.

The ground plane 12 is arranged on the surface of the substrate 43 opposite to the surface facing the radiating elements 22, 24. However, the ground plane 12 may be arranged on the surface of the substrate 43 facing the radiating elements 22, 24. The ground plane 12 may be arranged on the side surface of the substrate 43, or may be arranged inside the substrate 43. The ground plane 12 may be arranged on a member other than the substrate 43.

The substrate 43 includes a feeding element 21, a feeding point 14, and a ground plane 12 that is a ground level of the feeding point 14. Moreover, the substrate 43 further includes a transmission line provided with a strip conductor connected to the feeding point 14. The strip conductor is, for example, a signal line formed on a surface of the substrate 43 so as to hold the substrate 43 between the ground plane 12 and the strip conductor.

The radiating elements 22, 24 are arranged separated from the feeding element 21, and, as illustrated in the drawings, for example, are provided on the base substrate 38 facing the substrate 43, separated from the substrate 43 by a distance L15. The radiating elements 22, 24 are arranged on a surface of the base substrate 38 facing the feeding element 21. However, the radiating element 22, 24 may be arranged on a surface of the base substrate 38 opposite to the surface facing the feeding element 21, on a side surface of the base substrate 38, or on a member other than the base substrate 38.

The substrate 43 and the base substrate 38 are, for example, arranged parallel to the XY-plane, and substrates, a base material of which is a dielectric substance, a magnetic substance, or a mixture of a dielectric substance and a magnetic substance. A specific example of the dielectric substance includes a resin, a glass, a glass ceramics, an LTCC (Low Temperature Co-Fired Ceramics), alumina or the like. The mixture of the dielectric substance and the magnetic substance is required to include any one of a metal including a transition element such as Fe, Ni, or Co, a rare-earth element such as Sm or Nd and an oxide thereof. A specific example of the mixture of the dielectric substance and the magnetic substance includes a hexagonal ferrite, a spinel ferrite, (Mn—Zn based ferrite, Ni—Zn based ferrite or the like), a garnet ferrite, a permalloy, a Sendust (trademark registered) or the like.

When a metal is used in a part of the base substrate 38 (e.g. a housing forming a part or a whole of an outer shape of the wireless apparatus 101), the radiating elements 22, 24 may be the metal of the part of the housing. Recently, a region for implementing an antenna in a smartphone or the like is limited, and by using a metal used for a housing as the radiating elements, the space can be utilized effectively.

For the material of the base substrate 38, a resin such as the ABS resin may be used. Alternatively, a glass, a glass ceramics, or the like may be used. A glass may be a transparent glass, a colored glass, or an opalescent glass.

The radiating element 22 has the electrical length Le22 that gives the resonance frequency $f_{11}$ of the fundamental mode, and the radiating element 24 has the electrical length Le24 that gives the resonance frequency $f_{12}$ of the fundamental mode. That is, the antenna element 20 illustrated in FIG. 2 has a plurality of electrical lengths with different resonance frequencies. Because Le24 is smaller than Le 22, the resonance frequency $f_{12}$ is greater than the resonance frequency $f_{11}$. The feeding element 21 has the electrical length Le21 that gives the resonance frequency $f_{21}$ of the fundamental mode.

Because the tip portion 21*b* is located near the metal plate 32, an input impedance may decrease at the resonance frequency $f_{21}$ of the fundamental mode of the feeding element 21, and the feeding element 21 may not function sufficiently as a radiation conductor that resonates at the resonance frequency $f_{21}$. In such a case, the antenna device 1 would not function sufficiently as the multiband antenna that resonates at the resonance frequency $f_{21}$. However, because the antenna element 20 has the plurality of electrical lengths with different resonance frequencies, even if the feeding element 21 does not function as an antenna (radiation conductor) at the resonance frequency $f_{21}$, the antenna device 1 functions as a multiband antenna that resonates at the resonance frequency $f_{11}$ and resonance frequency $f_{12}$. That is, multiple frequency utilization for the antenna device 1 can be achieved.

In FIG. 3, the feeding element 21 is located between the radiating elements 22, 24 and the metal plate 32. For example, the shortest distance D3 between the tip portion 21*b* of the feeding element 21 and the metal plate 32 is greater than the shortest distance D4 between the tip portion 21*b* and the radiating elements. However, the shortest distance D3 may be the same as or smaller than the shortest distance D4. In the case illustrated in FIG. 3, the shortest distance D3 corresponds to L14+L13. The shortest distance D4 is the smaller distance between the shortest distance between the radiating element 22 and the tip portion 21*b* and the shortest distance between the radiating element 24 and the tip portion 21*b*. In the case illustrated in FIG. 3, the shortest distance D4 corresponds to L15. External dimensions such as line width, height or the like of the feeding element and radiating elements are ignored.

Figure 4:
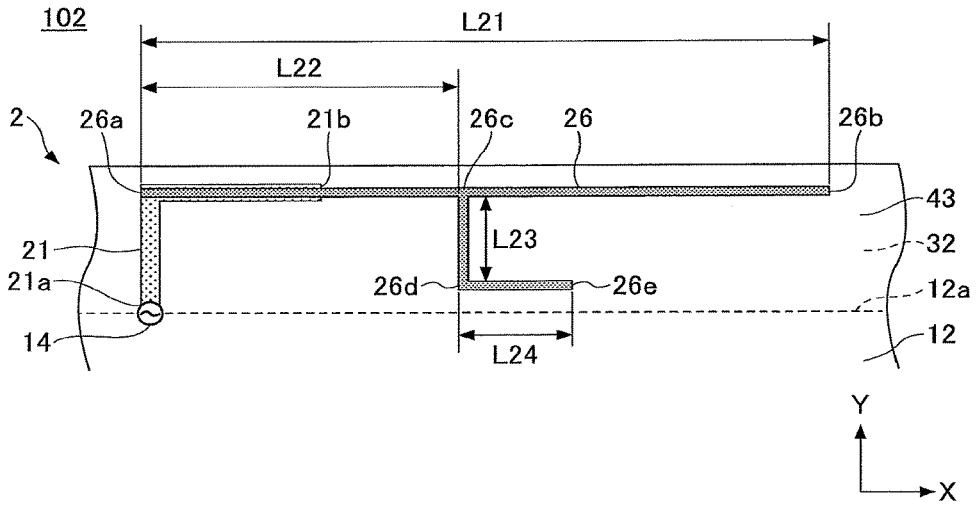
FIG. 4 is a front view partially depicting an example of an analysis model for an antenna different from the antenna device illustrated in FIG. 2.

FIG. 4 is a front view depicting an example of a simulation model on a computer for analyzing an operation of the antenna device 2 installed on the wireless apparatus 102. For configuration and effect of the wireless apparatus 102 and the antenna device 2, with respect to configuration and effect that are the same as those of the above-described wireless apparatus 101 and the antenna device 1, the descriptions thereof apply accordingly.

The antenna device 2 is the same as the antenna device 1 regarding the shape and configuration other than a radiating element 26. The radiating element 26 has a branching radiating element. The radiating element 26 branches at a branch point 26*c*, and thereby branches to a plurality of conductor portions.

The radiating element 26 has an electrical length Le261 that gives the resonance frequency $f_{11}$ of the fundamental mode, and an electrical length Le262 that gives the resonance frequency $f_{12}$ of the fundamental mode. That is, the radiating element 26 has the plurality of electrical lengths with different resonance frequencies. Le261 is a length determined by a physical length L21 of a conductor portion from an end portion 26*a* to an end portion 26*b*. Le262 is a length determined by a physical length (L22+L23+L24) of a conductor portion from the end portion 26*a* to an end portion 26*e* going through the branch point 26*c* and a bending portion 26*d*. Le262 is smaller than Le261, and the electrical length Le21 of the feeding element 21 is smaller than Le262.

Therefore, because the tip portion 21*b* is located near the metal plate 32, an input impedance may decrease at the resonance frequency $f_{21}$ of the fundamental mode of the feeding element 21, and the feeding element 21 may not function sufficiently as a radiation conductor that resonates at the resonance frequency $f_{21}$. In such a case, the antenna device 2 would not function sufficiently as the multiband antenna that resonates at the resonance frequency $f_{21}$. However, because the antenna element 26 has the plurality of electrical lengths with different resonance frequencies, even if the feeding element 21 does not function as an antenna (radiation conductor) at the resonance frequency $f_{21}$, the antenna device 2 functions as a multiband antenna that resonates at the resonance frequency $f_{11}$ and resonance frequency $f_{12}$.

Figure 5:
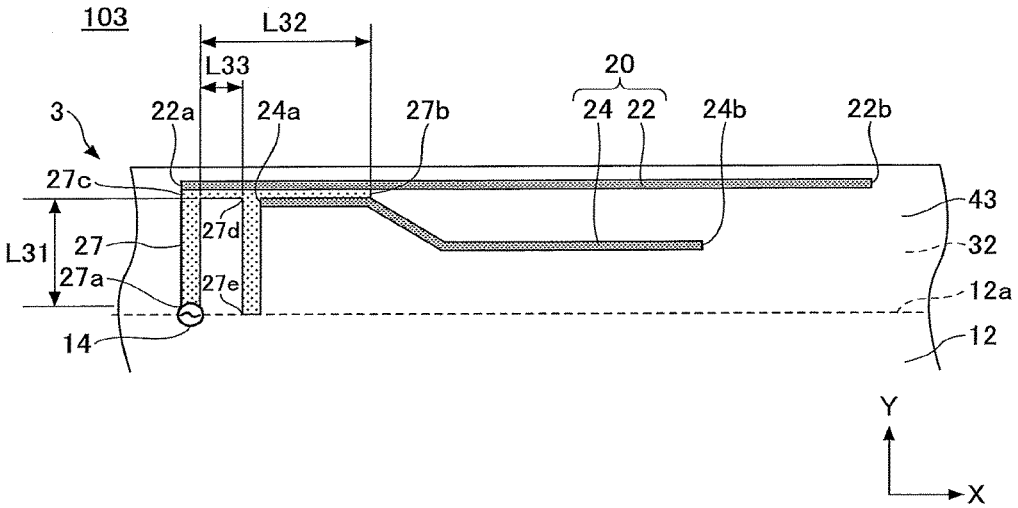
FIG. 5 is a front view partially depicting an example of an analysis model for an antenna different from the antenna devices illustrated in FIGS. 2 and 4.

FIG. 5 is a front view depicting an example of a simulation model on a computer for analyzing an operation of the antenna device 3 installed on the wireless apparatus 103. For configuration and effect of the wireless apparatus 103 and the antenna device 3, with respect to configuration and effect that are the same as those of the above-described wireless apparatus 101 and the antenna device 1, the descriptions thereof apply accordingly.

The antenna device 3 is the same as the antenna device 1 regarding the shape and configuration other than a feeding element 27. The feeding element 27 has an inverted F-shape. The feeding element 27 starts from an end portion 27*a*, is bent at a bending portion 27*c*, and extends to a tip portion 27*b*. Furthermore, an end portion 27*e* of a conductor portion branching at a branching portion 27*d* between the bending portion 27*c* and the tip portion 27*b* is connected to the outer edge portion 12*a* of the ground plane 12.

In the same way as the antenna device 1 and the antenna device 2, even when the tip portion 27*b* is located near the metal plate 32, the antenna device 3 functions as a multiband antenna that resonates also at the resonance frequency $f_{21}$, in addition to the resonance frequency $f_{11}$ and the resonance frequency $f_{12}$. Because the feeding element 27 has the inverted F-shape, even when the tip portion 27*b* is located near the metal plate 32, the input impedance is prevented from decreasing at the resonance frequency $f_{21}$ of the fundamental mode of the feeding element 27. Therefore, the feeding element 27 functions not only as a feeding conductor for feeding power to the antenna element 20 but also as a radiation conductor for resonating at the resonance frequency $f_{21}$.

Figure 6:
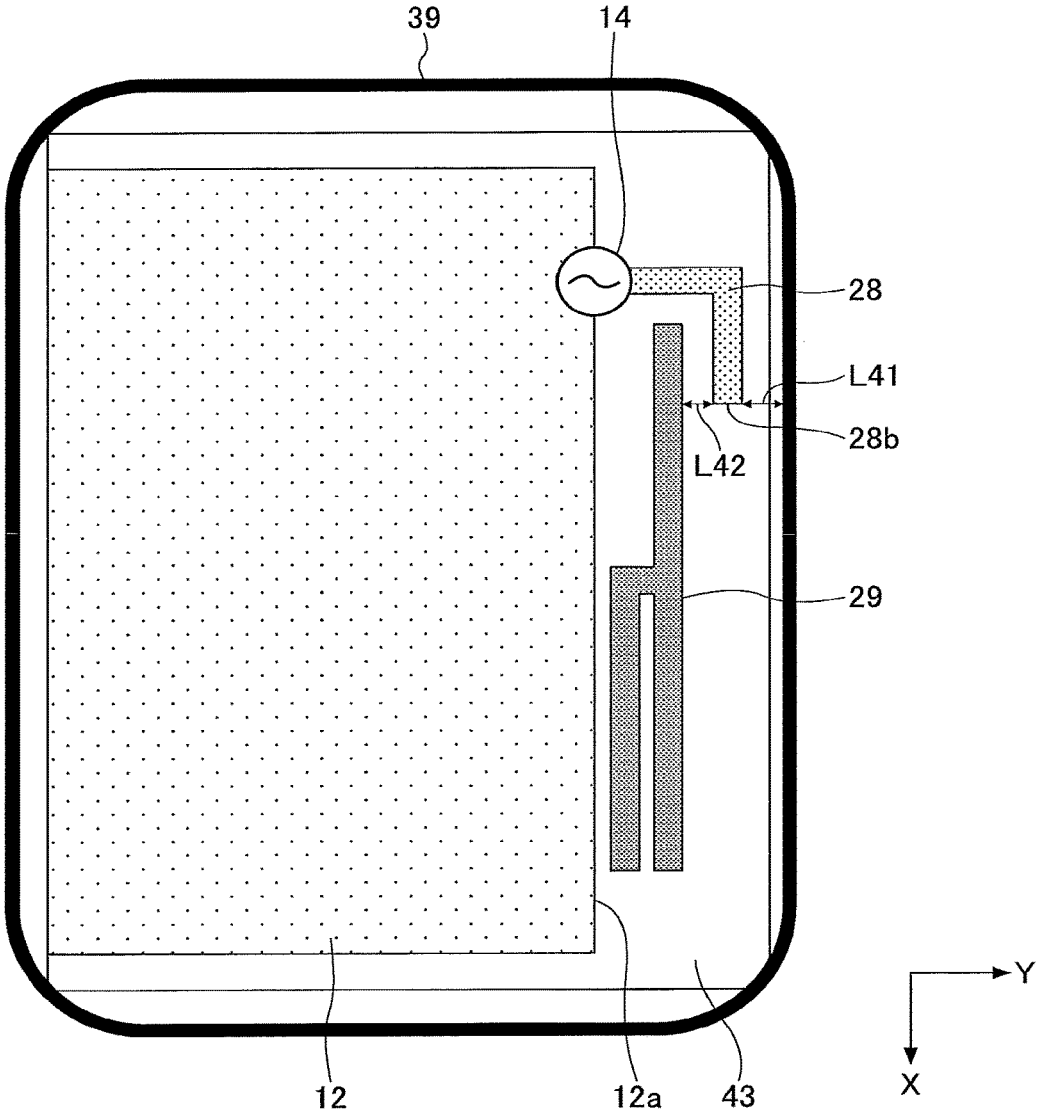
FIG. 6 is a front view depicting an example of a positional relationship among respective components of the wireless apparatus and the antenna device.
Figure 7:
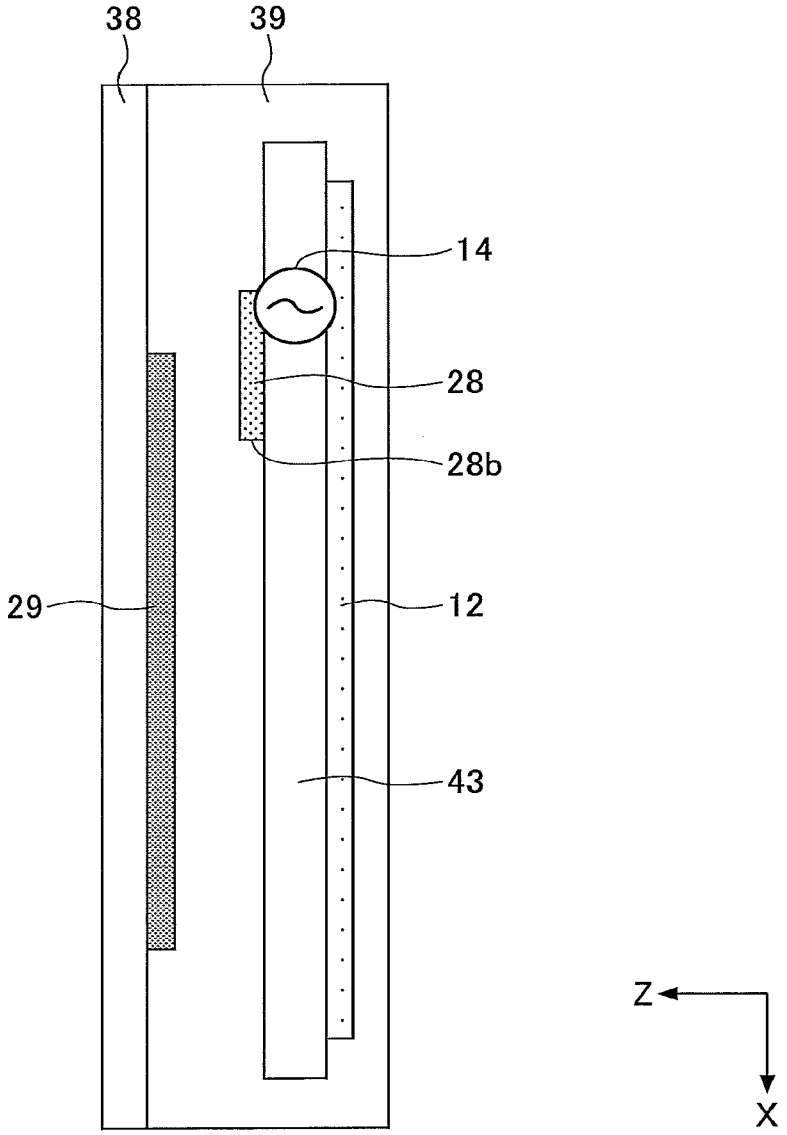
FIG. 7 is a side view depicting the example of the positional relationship among the respective configurations of the wireless apparatus and the antenna device.

FIG. 6 is a front view schematically depicting an example of a positional relationship among respective components of the wireless apparatus and the antenna device. FIG. 7 is a side view depicting the configuration illustrated in FIG. 6 viewed from the side. The antenna device is provided with the ground plane 12, the feeding element 28, and the radiating element 29, and surrounded by a metal frame 39. Even if the metal frame 39 is arranged near the tip portion 28*b* of the feeding element 28, it is possible to provide a multiband antenna device. The metal frame 39 is an example of a metal portion, and is, for example, a part forming a peripheral side surface of the wireless apparatus.

For example, the shortest distance L41 between the tip portion 28*b* of the feeding element 28 and the metal frame 39 may be greater than the shortest distance L42 between the tip portion 28*b* and the radiating element 29. However, the shortest distance L41 may also be the same as or smaller than the shortest distance L42.

Figure 13:
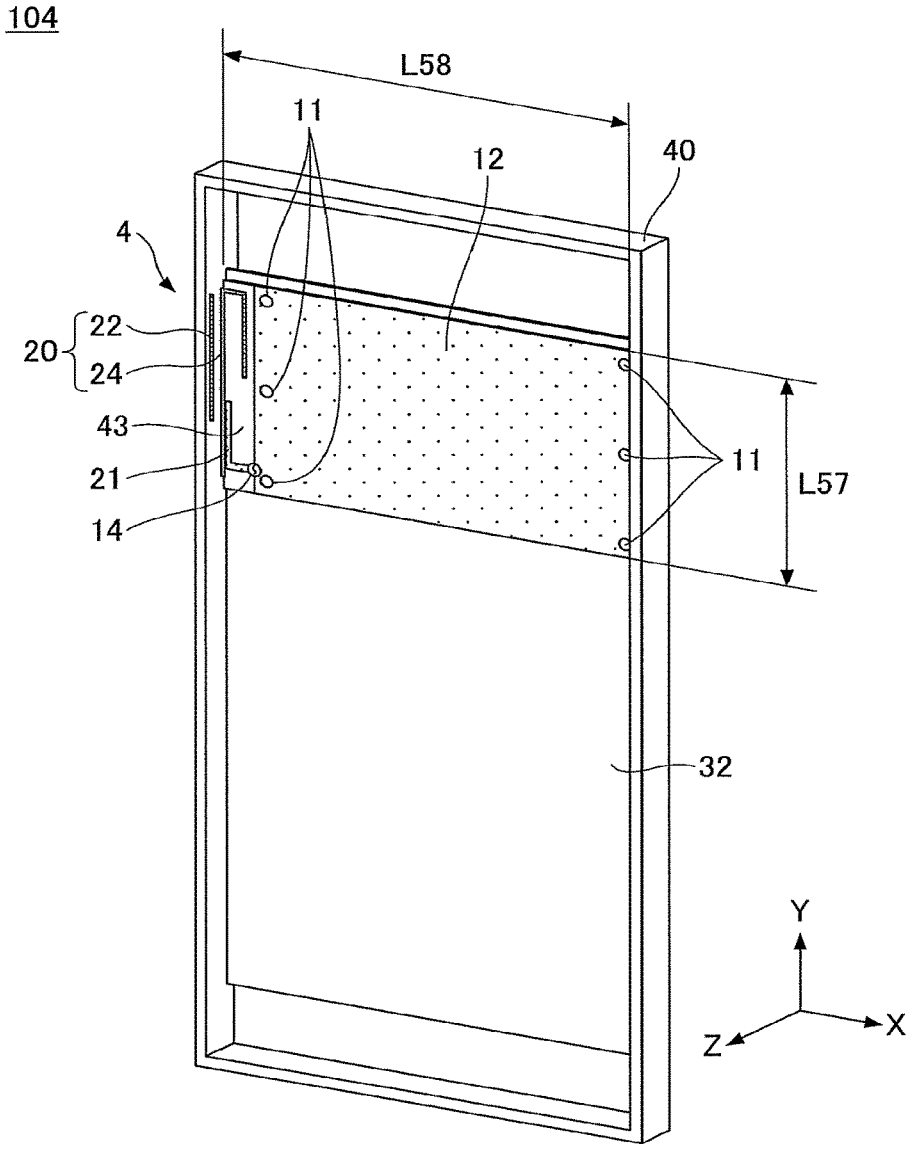
FIG. 13 is a perspective view depicting an example of an analysis model for an antenna device different from the antenna device illustrated in FIG. 1.

FIG. 13 is a perspective view depicting an example of a simulation model on a computer for analyzing an operation of an antenna device 4 installed on a wireless apparatus 4. For configuration and effect of the wireless apparatus 104 and the antenna device 4, with respect to configuration and effect that are the same as those of the above-described wireless apparatus 101 and the antenna device 1, the descriptions thereof apply accordingly. The wireless apparatus 104 includes a housing 40, a metal plate 32, and the antenna device 4.

The housing 40 is a part formed to be vertically long along the Y-axis direction and stores the metal plate 32 and the antenna device 4. The housing 40 may be an electrically conductive member, or an electrically non-conductive member.

The metal plate 32 is a part formed to be vertically long along the Y-axis direction, and is similar to the metal plate 32 illustrated in FIG. 1. The external dimension of the metal plate 32 in the Y-axis direction is greater than the external dimension of the ground plane 12 in the Y-axis direction.

The antenna device 4 includes, similarly to the antenna device 1, a ground plane 12, a feeding element 21, and an antenna element 20. The antenna element 20 includes a radiating element 22 (an example of the first radiating element) and a radiating element 24 (an example of the second radiating element).

The ground plane 12 is arranged on a substrate 43 that is wider than the ground plane 12 in the X-axis direction. The ground plane 12 is connected to the metal plate 32 to enable conduction by a plurality of connection members 11. In FIG. 13, as the plurality of connection members 11, six via holes are depicted.

Figure 14:
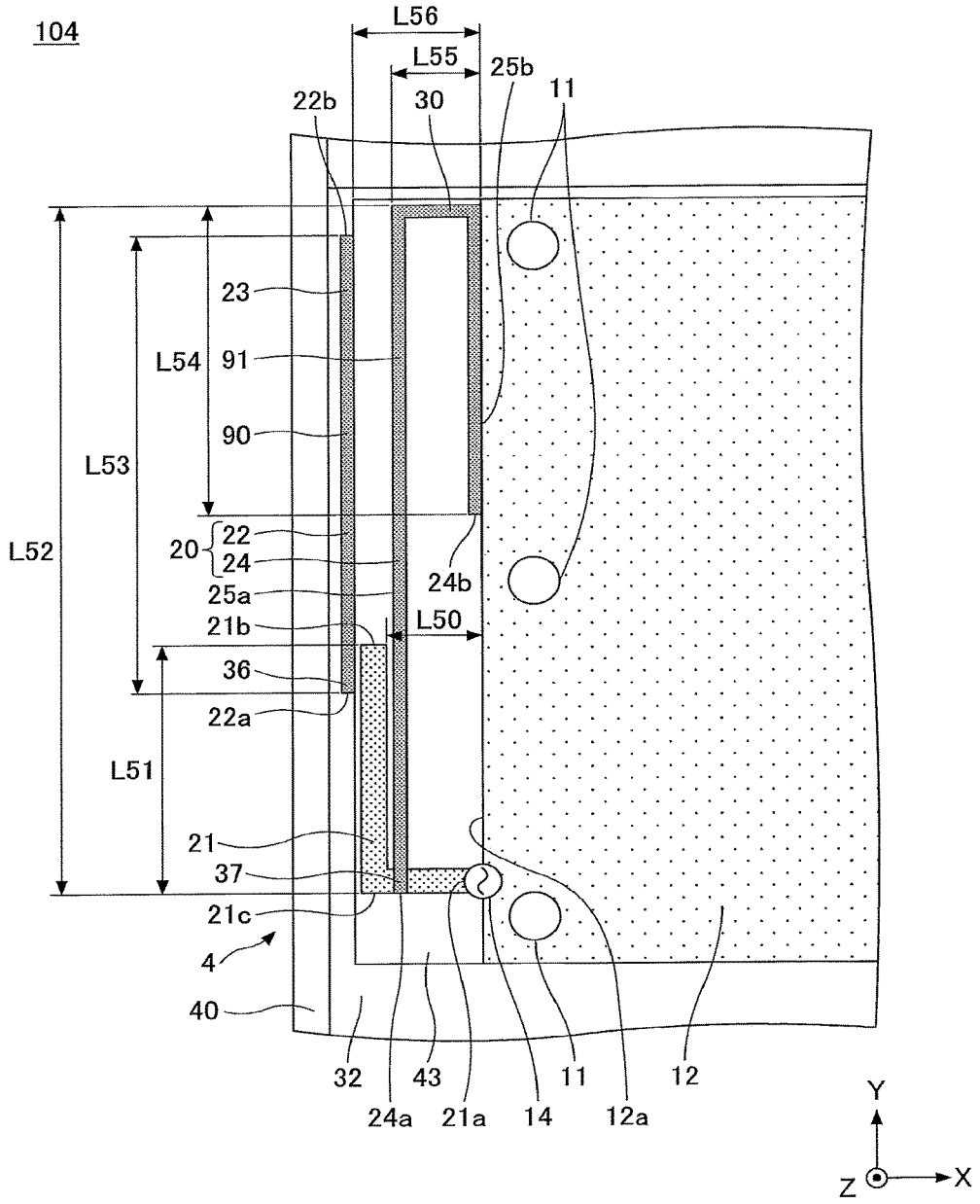
FIG. 14 is a front view partially depicting an example of the analysis model illustrated in FIG. 13.

FIG. 14 is a front view partially depicting an example of the analysis model illustrated in FIG. 13. The shape of the feeding element 21 of the antenna device 4 is the same as the shape of the feeding element 21 of the antenna device 1, and the shape of the radiating element 22 of the antenna device 4 is the same as the shape of the radiating element 22 of the antenna device 1. However, the shape of the radiating element 24 of the antenna device 4 is different from the shape of the radiating element 24 of the antenna device 1 in that a turnaround portion 30 is present.

The turnaround portion 30, viewed from a direction perpendicular to the ground plane 12 (in the case illustrated in the drawings, viewed from the Z-axis direction that is perpendicular to the X-Y plane), is not located between the feeding element 21 and the ground plane 12 so as not to be connected to the feeding element 21, but is located between the radiating element 22 and the ground plane 12. The turnaround portion 30 is a conductor portion that bends to have a U-shape between a central portion 91 and an end portion 24*b*. The central portion 91 is a part at half the entire length from one end portion 24*a* to the other end portion 24*b* in the radiating element 24.

In the same way as the antenna device 1, the antenna device 4 can also function as a multiband antenna, in which the radiating element 22 resonates at the resonance frequency $f_{11}$ of the fundamental mode (first order mode), and the radiating element 24 resonates at the resonance frequency $f_{12}$ of the fundamental mode (first order mode). Moreover, in the same way as the antenna device 1, the antenna device 4 can also function as a multiband antenna, in which the radiating element 22 uses the second order mode for resonating at the resonance frequency $f_{112}$ that is about twice the resonance frequency $f_{11}$, and the radiating element 24 uses the second order mode for resonating at the resonance frequency $f_{122}$ that is about twice the resonance frequency $f_{12}$. That is the antenna device 4 can function as a multiband antenna that resonates at four resonance frequencies $f_{11}$, $f_{112}$, $f_{12}$, and $f_{122}$.

Then, in the same way as in the antenna device 1, the antenna element 20 has a plurality of electrical lengths with different resonance frequencies. Therefore, even if the feeding element 21 does not function as an antenna (radiation conductor) at the resonance frequency $f_{21}$, the antenna device 4 can function as a multiband antenna that resonates at three resonance frequencies $f_{11}$, $f_{12}$, and $f_{122}$, or at four resonance frequencies $f_{11}$, $f_{112}$, $f_{12}$, and $f_{122}$.

Here, because the second radiating element 24 is provided with the turnaround portion 30 at the above-described position, it becomes easier to adjust a value of the resonance frequency $f_{122}$ of the second mode of the radiating element 24, compared with the form that is not provided with the turnaround portion 30. Then, for example, bringing a value of the resonance frequency $f_{122}$ of the second order mode of the radiating element 24 close to the value of the resonance frequency $f_{11}$ of the fundamental mode of the radiating element 22 easily makes it possible to provide a wideband antenna device.

Moreover, the entire length of the radiating element 24 is greater than the entire length of the radiating element 22. However, because the radiating element 24 bends at the turnaround portion 30, a size of the antenna device 4 can be easily reduced, compared with the form that is not provided with the turnaround portion 30. Moreover, because the radiating element 22 has a conductor portion 23 that extends along at least one of the conductor portion 25*a* and the conductor portion 25*b* of the radiating element 24, the size of the antenna device 4 can be easily reduced, compared with the form in which the conductor portion 23 does not extend along at least one of the conductor portion 25*a* and the conductor portion 25*b*. For example, the radiating element 22 has the conductor portion 23 that extends in parallel with at least one of the conductor portion 25*a* and the conductor portion 25*b* that extends in a direction parallel to the Y-axis direction.

The conductor portion 25*b* is a part of the turnaround portion 30, and extends along the outer edge portion 12*a* of the ground plane 12. The turnaround portion 30 has a shape that turns toward a side close to the outer edge portion 12*a* of the ground plane 12.

Next, results of analysis for an S11 characteristic will be described for the case where the second resonator does not have a plurality of electrical lengths with different resonance frequencies (comparative example) and for the case where the second resonator has the plurality of electrical lengths with different resonance frequencies (example).

Figure 8:
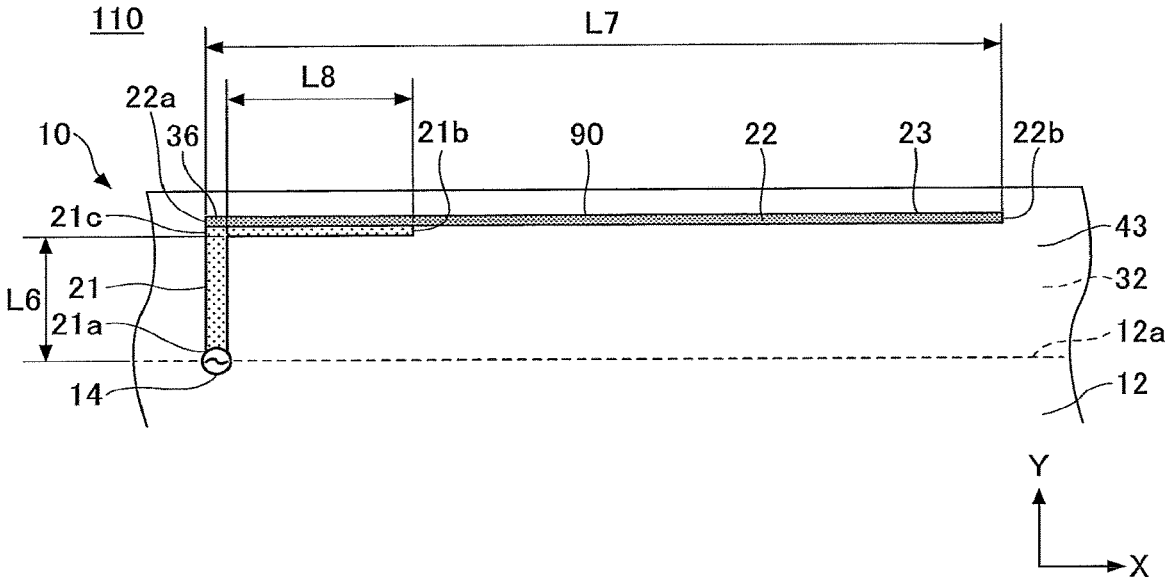
FIG. 8 is a front view partially depicting an example of an analysis model for an antenna different from the antenna devices illustrated in FIGS. 2, 4, and 5 according to a comparative example.

FIG. 8 is a front view depicting an example (comparative example) of a simulation model on a computer for analyzing an operation of the antenna device 10 installed on the wireless apparatus 110. The antenna device 10 is different from the antenna device in that the radiating element 24 is absent. That is, the antenna device 10 is provided with a second resonator (in this case, the radiating element 22) having an electrical length that gives a fundamental mode.

Figure 9:
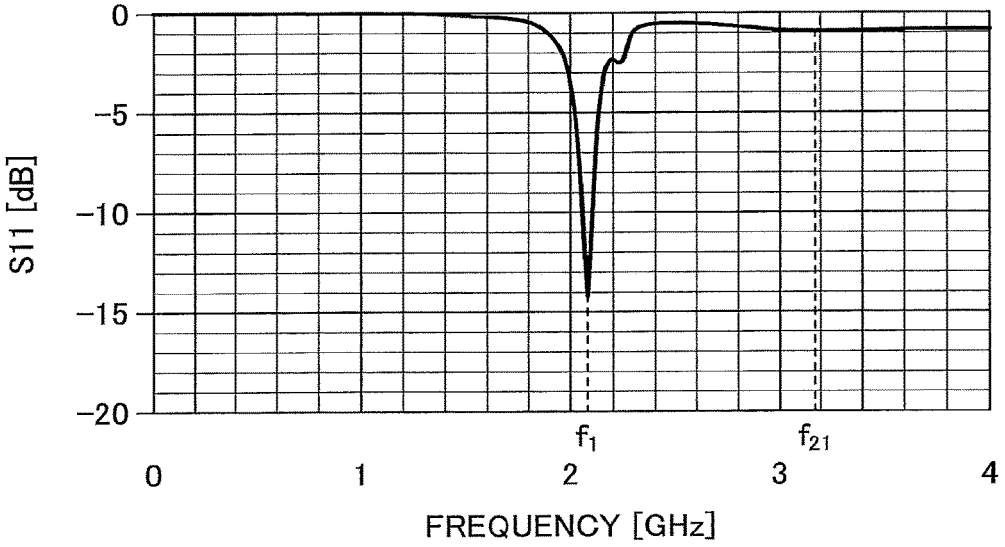
FIG. 9 is an S11 characteristic diagram for the antenna device illustrated in FIG. 8.

FIG. 9 is an S11 characteristic diagram for the antenna device 10 (comparative example).

Figure 10:
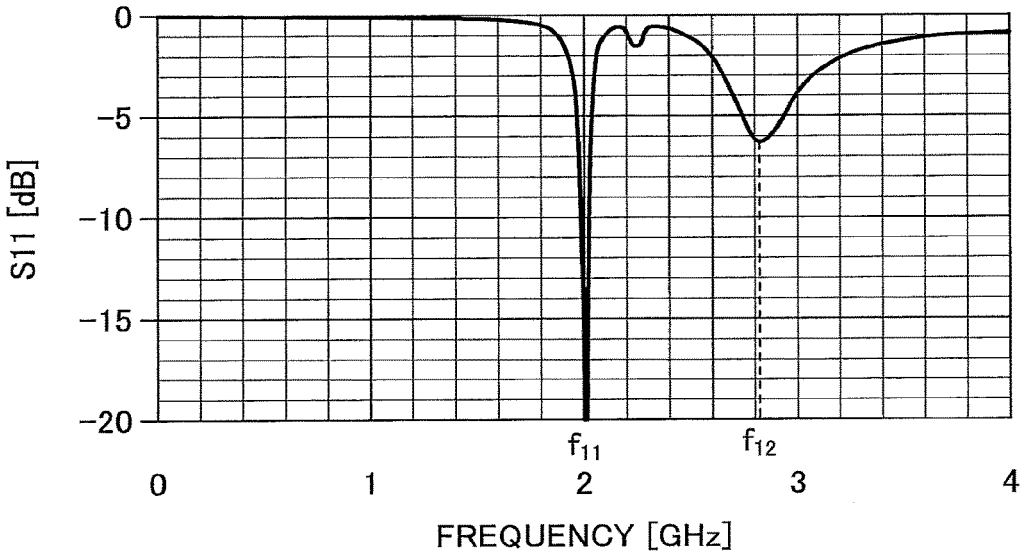
FIG. 10 is an S11 characteristic diagram for the antenna device illustrated in FIG. 2.
Figure 11:
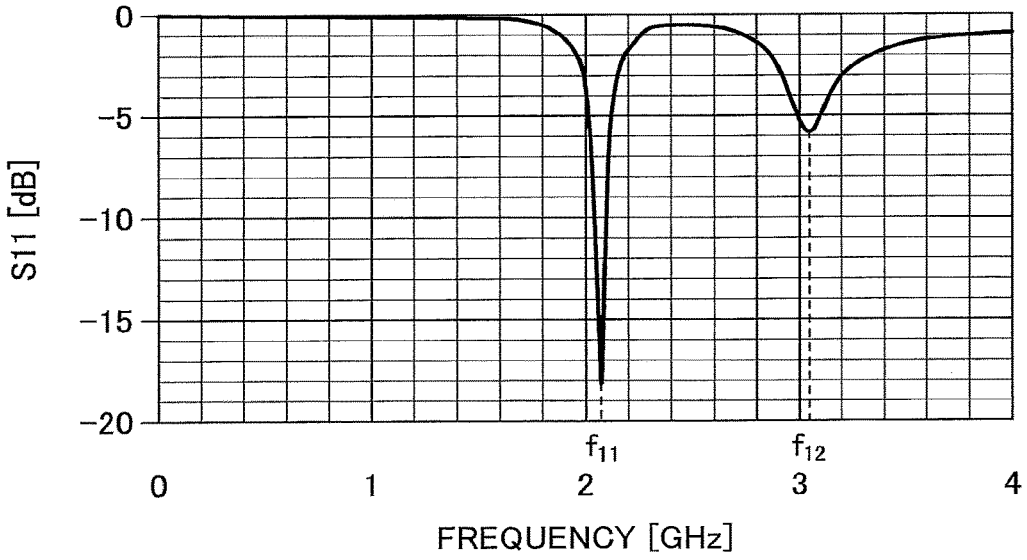
FIG. 11 is an S11 characteristic diagram for the antenna device illustrated in FIG. 4.
Figure 12:
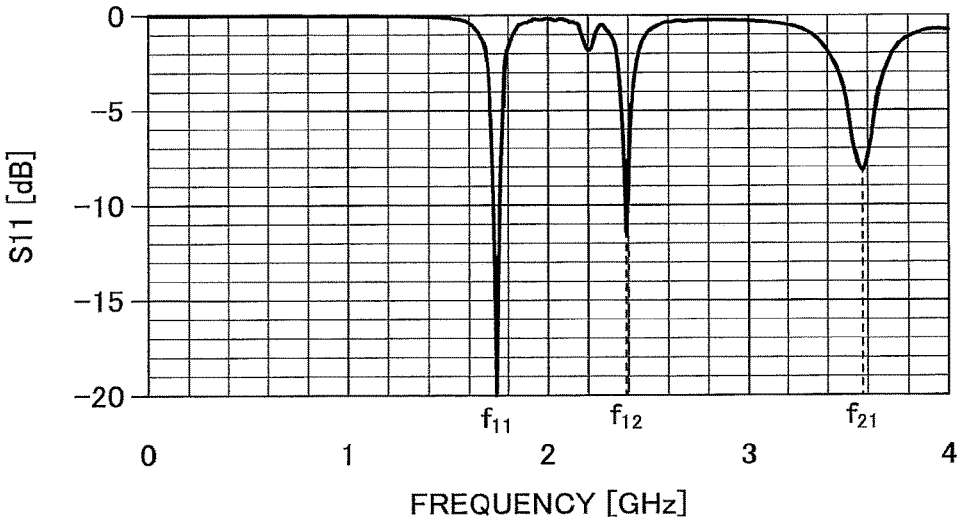
FIG. 12 is an S11 characteristic diagram for the antenna device illustrated in FIG. 5.

FIG. 10 is an S11 characteristic diagram for the antenna device 1 (example 1), FIG. 11 is an S11 characteristic diagram for the antenna device 2 (example 2), and FIG. 12 is an S11 characteristic diagram for the antenna device 3.

The respective dimensions illustrated in FIG. 1 upon performing measurements for FIGS. 9 to 12 are (in unit of mm).

L1: 60,
L2: 8,
L3: 20,
L4: 90, and
L5: 65.

External dimensions of the substrate 43 and the metal plate 32 are the same as the external dimensions of the substrate 38 (vertical: L1, and horizontal: L4).

The respective dimensions illustrated in FIG. 3 upon performing measurements for FIGS. 9 to 12 are (in unit of mm), L13: 3,
L14: 0.8,
L15: 3.5 (upon measuring for FIGS. 9, 10, and 11),
L15: 0.5 (upon measuring for FIG. 12), and
L16: 1.

The line width of the feeding element is assumed to be 1 mm, and the line width of the radiating element is assumed to be 0.5 mm.

The respective dimensions illustrated in FIGS. 2, and 8 upon performing measurements for FIGS. 9 and 10 are (in unit of mm), L6: 8,
L7: 44,
L8: 11,
L9: 3,
L10: 7,
L11: 5, and
L12: 15.

The respective dimensions illustrated in FIG. 4 upon performing measurements for FIG. 11 are (in unit of mm), L21: 44,
L22: 20,
L23: 6, and
L24: 7.

The respective dimensions illustrated in FIG. 5 upon performing measurements for FIG. 12 are (in unit of mm), L31: 8,
L32: 11, and
L33: 2.5.

In the case of the antenna device 10 (comparative example) illustrated in FIG. 8, the plate 32 is present near the tip portion 21*b*. Therefore, even if the feeding element 21 has the electrical length that can resonate at the resonance frequency $f_{21}$, as illustrated in FIG. 9, although the antenna device 10 can function as an antenna that resonates at the resonance frequency $f_1$ of the fundamental mode of the radiating element 22, the antenna device 10 does not function as an antenna that resonates at the resonance frequency $f_{21}$.

However, in the case of the antenna devices 1, 2 and 3 (examples) illustrated in FIGS. 2, 4, and 5, respectively, even if the metal plate 32 is present near the tip portion 21*b* or 27*b*, as illustrated in FIGS. 10, 11, 12, the respective antenna devices function as multiband antennas that resonate at the two resonance frequencies of the fundamental mode $f_{11}$, $f_{12}$. Especially, the antenna device 3, as illustrated in FIG. 12, functions as a multiband antenna of three bands that also resonates at the resonance frequency $f_{21}$ of the fundamental mode of the feeding element 27.

Figure 15:
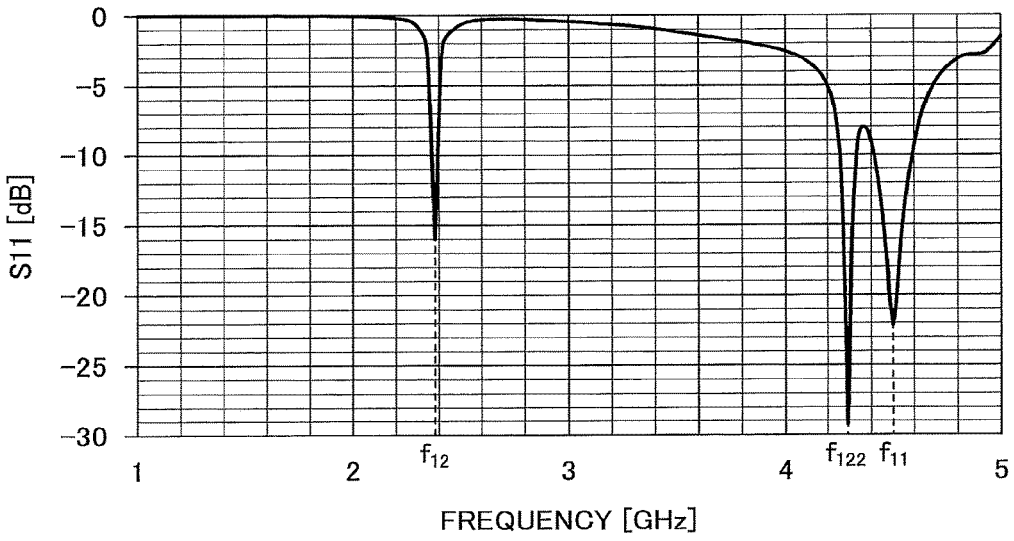
FIG. 15 is an S11 characteristic diagram for the antenna device illustrated in FIG. 14.

FIG. 15 is an S11 characteristic diagram for the antenna device 4 illustrated in FIGS. 13 and 14. The respective dimensions illustrated in FIGS. 13 and 14 upon performing measurements for FIG. 15 are (in unit of mm), L50: 4,
L51: 10,
L52: 29,
L53: 19,
L54: 13,
L55: 3.5,
L56: 5,
L57: 33, and
L58: 65.

The shape of the substrate 43 is a rectangle with a vertical length of L57 and a horizontal length of L58, and the shape of the ground plane 12 is a rectangle with a vertical length of L57 and a horizontal length of (L58-L56). Moreover, a length of a Z-axis direction component of a distance between an arrangement surface of the substrate 43 on which the feeding element 21 is arranged and an arrangement surface on which the radiating elements 22, 24 are arranged is 2.8 mm.

The antenna device 4 according to the embodiment can function as a multiband antenna that resonates at three resonance frequencies f11, f12 and f122, even if the metal plate 32 is present near the tip portion 21*b*, as illustrated in FIG. 15. Particularly, because the resonance frequency f11 can be brought close to the resonance frequency f122 by the turnaround portion 30, a wideband antenna device in a frequency band from 4 GHz to 5 GHz can be provided.

As described above, embodiments or the like of the antenna device and the wireless apparatus have been described. However, the present invention is not limited to the embodiments. Various variations and modifications such as combination with or replacement by a part or whole of the other embodiment may be made without departing from the scope of the present invention recited in claims.

For example, the second resonator is not limited to the case of having two electrical lengths with different resonance frequencies, but may have three or more electrical lengths with difference resonance frequencies. Moreover, the second resonator having a form in which a conductor branches and the first resonator having an inverted F-form may be combined. A plurality of antenna devices may be installed in a wireless apparatus.

When, in the antenna device disclosed in WO 2014/013840, a metallic portion is present near a tip portion of the first resonator, an operation of the first resonator as an antenna may not be obtained sufficiently, and it may be impossible to provide a multiband antenna device.

The present invention aims at providing an antenna device and a wireless apparatus that can provide a multiband antenna device even if a metallic part is present near a tip portion of the first resonator.

According to the embodiment, even if a metallic part is present near the tip portion of the first resonator, it is possible to provide a multiband antenna device.

What is claimed is:

1. An antenna device, comprising:

a ground plane;

a first resonator extending in a direction at a distance from the ground plane and connected to a feeding point; and a second resonator positioned at a distance from the first resonator, wherein the ground plane includes an edge portion formed along the second resonator, such that a resonance current is formed on the first resonator and the ground plane, the second resonator is configured to function as a radiation conductor by resonance of the first resonator, a tip portion of the first resonator is positioned near a metallic part, the second resonator has a plurality of electrical lengths with differing resonance frequencies and has a plurality of radiating elements including a first radiating element and a second radiating element, and the second radiating element includes a turnaround portion formed between the first radiating element and the ground plane and not formed between the first resonator and the ground plane when viewed from a direction perpendicular to the ground plane.

2. The antenna device according to claim 1, wherein the first radiating element has a conductor portion that extends along a conductor portion of the second radiating element.

3. The antenna device according to claim 2, wherein the first resonator has an inverted-F shape.

4. The antenna device according to claim 2, wherein the first resonator is formed between the second resonator and the metallic part.

5. The antenna device according to claim 1, wherein an entire length of the second radiating element is greater than an entire length of the first radiating element.

6. The antenna device according to claim 5, wherein the first radiating element has a conductor portion that extends along a conductor portion of the second radiating element.

7. The antenna device according to claim 5, wherein the first resonator has an inverted-F shape.

8. The antenna device according to claim 5, wherein the first resonator is formed between the second resonator and the metallic part.

9. The antenna device according to claim 1, wherein the second resonator has a radiating element that branches.

10. The antenna device according to claim 1, wherein the first resonator has an inverted-F shape.

11. The antenna device according to claim 1, wherein the first resonator is formed between the second resonator and the metallic part.

12. The antenna device according to claim 1, wherein the metallic part is a display or a shield plate.

13. A wireless apparatus, comprising:

a metallic part; and an antenna device comprising a ground plane, a first resonator extending in a direction at a distance from the ground plane and connected to a feeding point, and a second resonator positioned at a distance from the first resonator, wherein the ground plane includes an edge portion formed along the second resonator such that a resonance current is formed on the first resonator and the ground plane, the second resonator is configured to function as a radiation conductor by resonance of the first resonator, a tip portion of the first resonator is positioned near the metallic part, the second resonator has a plurality of electrical lengths with differing resonance frequencies and has a plurality of radiating elements including a first radiating element and a second radiating element, and the second radiating element includes a turnaround portion formed between the first radiating element and the ground plane and not formed between the first resonator and the ground plane when viewed from a direction perpendicular to the ground plane.

14. The wireless apparatus according to claim 13, wherein the first radiating element has a conductor portion that extends along a conductor portion of the second radiating element.

15. The wireless apparatus according to claim 13, wherein an entire length of the second radiating element is greater than an entire length of the first radiating element.

16. The wireless apparatus according to claim 15, wherein the first radiating element has a conductor portion that extends along a conductor portion of the second radiating element.

17. The wireless apparatus according to claim 13, wherein the second resonator has a radiating element that branches.

18. The wireless apparatus according to claim 13, wherein the first resonator has an inverted-F shape.

19. The wireless apparatus according to claim 13, wherein the first resonator is formed between the second resonator and the metallic part.

20. The wireless apparatus according to claim 13, wherein the metallic part is a display or a shield plate.

* * * * *